US005310437A

United States Patent [19]

Tucker

[11] Patent Number: 5,310,437

[45] Date of Patent: May 10, 1994

[54] SINGLE SPOOL CORRECTION TAPE DISPENSER

[75] Inventor: William E. Tucker, Attleboro, Mass.

[73] Assignee: The Gillette Company, Boston, Mass.

[21] Appl. No.: 961,499

[22] Filed: Oct. 15, 1992

[51] Int. Cl.[5] ..... B32B 31/00

[52] U.S. Cl. ..... 156/238; 156/247; 156/577; 156/579; 242/194

[58] Field of Search ..... 156/577, 579, 523, 584, 156/527, 574, 238, 239, 247, 249; 242/193, 194

[56] References Cited

U.S. PATENT DOCUMENTS

| | | | |
|---|---|---|---|
| Re. 32,010 | 10/1985 | Collins | 156/527 |
| D. 214,405 | 6/1969 | Fleming | D74/1 |
| D. 238,360 | 1/1976 | Gibbs | D19/69 |
| D. 298,339 | 11/1988 | Eisenberg | D19/67 |
| D. 310,846 | 9/1990 | Sakurai | D19/69 |
| 3,839,127 | 10/1974 | Hazuka et al. | 156/540 |
| 3,850,779 | 11/1974 | Pearson | 156/523 |
| 3,902,956 | 9/1975 | Thompson, Jr. | 156/523 |
| 3,930,697 | 1/1976 | Barouh et al. | 312/39 |
| 4,220,495 | 9/1980 | Uchida | 156/577 |
| 4,336,097 | 6/1982 | Van Kampen et al. | 156/527 |
| 4,591,407 | 5/1986 | Samuelson | 156/527 |
| 4,676,861 | 6/1987 | Bishop | 156/527 |
| 4,704,185 | 11/1987 | Fischer | 156/577 |
| 4,772,355 | 9/1988 | Leahy | 156/584 |
| 4,824,517 | 4/1989 | Leahy | 156/584 |
| 4,849,064 | 7/1989 | Manusch et al. | 156/577 |
| 4,851,074 | 7/1989 | Uchida | 156/577 |
| 4,851,076 | 7/1989 | Manusch et al. | 156/577 |
| 4,853,074 | 8/1989 | Manusch et al. | 156/577 |
| 4,997,512 | 3/1991 | Manusch | 156/486 |
| 5,000,815 | 3/1991 | Hanna | 156/542 |
| 5,006,184 | 4/1991 | Manusch et al. | 156/577 |
| 5,049,229 | 9/1991 | Czech | 156/577 |
| 5,125,589 | 6/1992 | Manusch | 242/67.30 R |

FOREIGN PATENT DOCUMENTS

| | | | |
|---|---|---|---|
| 2114951 | 9/1983 | United Kingdom | B65H 49/18 |

*Primary Examiner*—David A. Simmons
*Assistant Examiner*—William J. Matney, Jr.
*Attorney, Agent, or Firm*—Owen J. Meegan; Aubrey C. Brine; Donal B. Tobin

[57] ABSTRACT

A hand operated device for transferring an adhesive film from a carrier tape to a substrate is provided with a single spool having a portion containing the roll of carrier tape and a large diameter portion having a plurality of knurls formed on the circumference thereof. The tape is fed from the spool to contact the substrate and then fed between the knurls. A spring arm serves as a clutch by maintaining the tape in contact with the knurls but allowing slippage of the tape therebetween at a predetermined tape tension.

15 Claims, 3 Drawing Sheets

SINGLE SPOOL CORRECTION TAPE DISPENSER

BACKGROUND OF THE INVENTION

The present invention relates to a device for applying a correction film to a substrate surface and more particularly to a hand operated device for transferring a film from a carrier tape to a substrate such as paper.

A number of devices are known which are designed to apply an adhesive film to a surface, the film generally being provided on a carrier tape, and being of the type which adheres to the substrate surface when pressure is applied against the tape at the surface. Typical of such devices are those disclosed and described in U.S. Pat. No. 4,849,064, U.S. Pat. No. 4,851,076, and U.S. Pat. No. 4,853,074 each issued in the name of Manusch et al.

Such devices are generally formed of a housing having a feed reel or spool containing the carrier tape, and a second spool for accepting the tape after usage, the tape being fed over an applicator member which extends from the housing and is generally disposed on a spring support of some type. The device is held in the hand of the user who applies the applicator to the substrate and exerts that pressure sufficient to press the tape against the substrate for transfer of the film to the substrate.

In general, devices of the type referred to are designed such that the movement of the tape over the substrate causes the tape to unwind from the feed spool while maintaining a predetermined tension in the tape, and rotation of the feed spool causes the take-up spool to wind the used tape thereon. As it is desirable to maintain a tension between the applicator and the take-up spool without subjecting the tape to breakage, the feed spool is generally operatively connected to the take-up spool by a clutch arrangement allowing for slippage during the driving operation, however maintaining the proper tension in the tape to ensure its effective feeding over the applicator member.

It is evident, therefore, that a plurality of elements are required in an assembly designed to accomplish application of the correction film to a substrate, when devices of the prior art are employed.

The present invention therefore has as an object to provide a correction tape dispenser of the type described which is simple in construction and economical to produce.

A further object of the invention is to provide a correction tape dispenser having a single spool for supporting the carrier tape and for receiving the carrier tape after usage.

Another object of the invention is to provide a method of transferring film from a carrier tape to a substrate which is accomplished with a minimum number of elements and, therefore, is economical to perform.

SUMMARY OF THE INVENTION

The above objects, and other objects which will become apparent as the description proceeds, are accomplished by providing a hand operated device for transferring a film from a carrier tape to a substrate which comprises wall structure forming a housing having an applicator means, and a single spool mounted for rotation, within the housing. The spool has a portion disposed for carrying a roll of carrier tape supported for feeding the carrier tape over the applicator means and an outer perimeter of the spool is disposed for receiving the carrier tape after its passage over the applicator means. A spring means is mounted in a manner to force the carrier tape against the spool perimeter and allow slippage between the spool perimeter and the carrier tape. Generally, the roll of carrier tape is of a diameter less than the spool diameter forming the spool outer periphery and the spool perimeter may be provided with a plurality of radially extending knurls for contacting the carrier tape.

The spring means may comprise a leaf spring arm having one end supported on the housing wall structure and the free end contacting the spool perimeter.

After being fed between the spool perimeter and the spring means, the wall structure may include means for retaining the used carrier tape or the wall structure may be provided with means for feeding the carrier tape from within the housing, where it can be disposed of by the user after each operation.

The method of transferring the film from a carrier tape to a substrate includes the steps of providing a housing having a single spool containing a roll of carrier tape and applicator means for contacting the substrate. The carrier tape is fed from the single spool over the applicator means and over the periphery of the single spool and pressure is applied to the carrier tape at the area of contact with the spool periphery, which pressure is of sufficient force to cause friction between the spool periphery and the carrier tape to feed the carrier tape and to allow slippage between the spool periphery and the carrier tape when the carrier tape is subjected to a predetermined tensile force.

BRIEF DESCRIPTION OF THE DRAWING

Reference is made to the accompanying drawing in which there is shown an illustrative embodiment of the invention from which its novel features and advantages will be apparent, where.

DESCRIPTION OF THE PREFERRED EMBODIMENT

Figure 1:
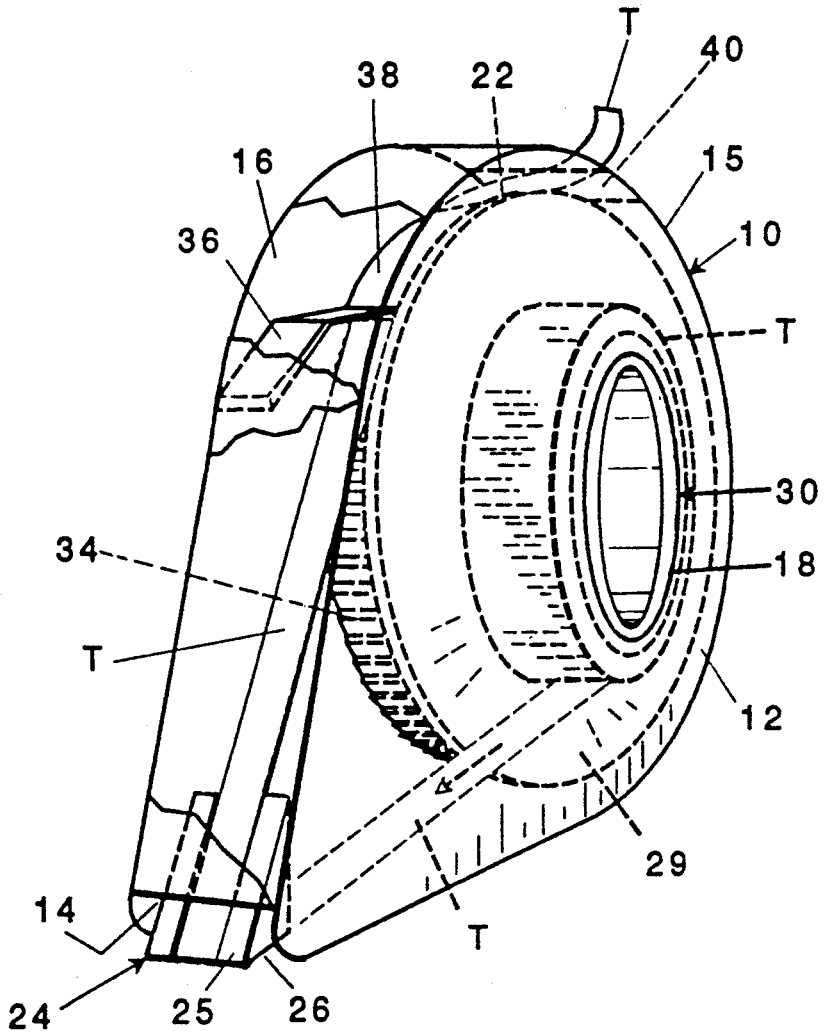
FIG. 1 is a left side perspective view partially in section showing a correction tape dispenser constructed in accordance with the teaching of the present invention.
Figure 5:
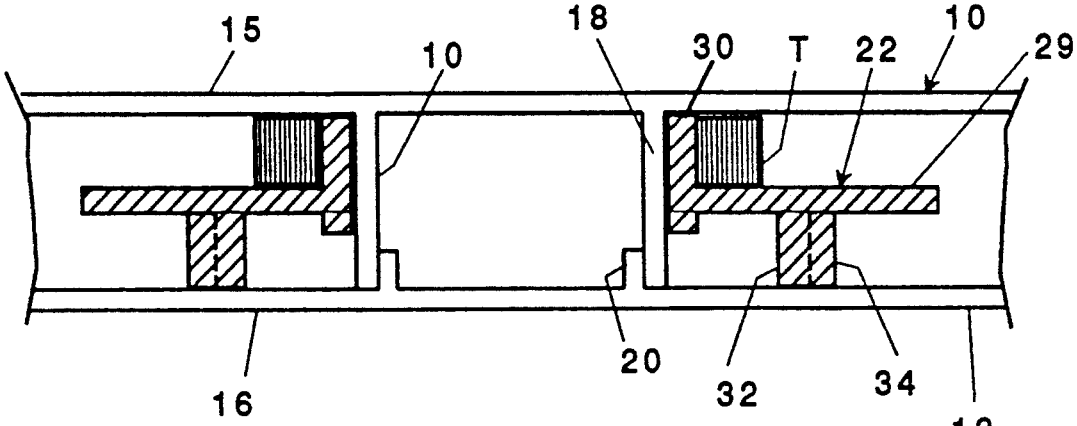
FIG. 5 is a fragmentary sectional view taken through axis of the spool in FIG. 1 showing details of the mounting of the spool taken on an enlarged scale for clarity.

Referring to the drawing there is shown at FIGS. 1 and 5 a hand operated device 10 for transferring a film from a carrier tape to a substrate having wall structure forming a housing 12 having an opening 14 formed at the forward end thereof. The wall structure includes side walls 15 and 16 the side wall 15 having a cylindrical portion 18 which is received as a force fit over a cylindrical portion 20 disposed on the inner surface of side wall 16, to form an axial support for a spool 22.

At the forward end of the housing 12 an applicator means in the form of a triangular shaped wedge 24 is mounted between the side walls 15 and 16, the wedge extending beyond the side walls and having upper surface 25 and lower surface 26 for supporting a carrier tape T and applying it to a substrate surface in a manner well known in the art. The applicator means shown herein is of a simplified construction but may take a number of forms which are shown in the prior art referred to above. However, the various forms which the applicator means may take will not be discussed in detail, as it may be of any type which allows the user to provide pressure between the tape and the substrate of sufficient magnitude to apply the adhesive film to the substrate.

Figure 2:
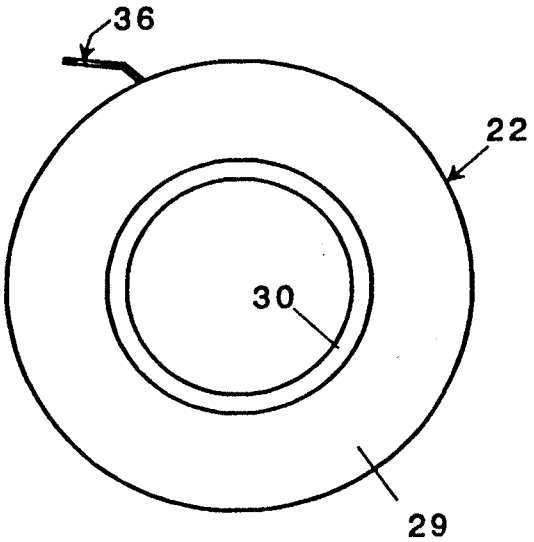
FIG. 2 is a left side elevational view showing details of the spool employed in the tape dispenser of FIG. 1.
Figure 4:
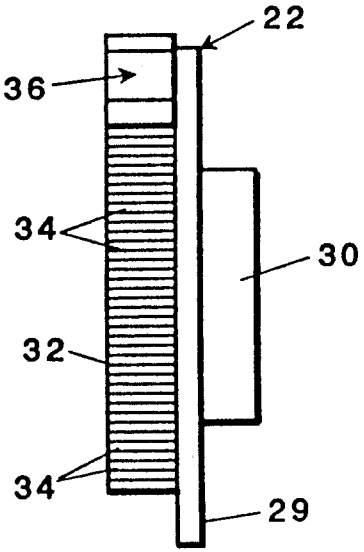
FIG. 4 is a front elevational view of the spool of FIGS. 1 through 3 showing portions of the spool in detail.
Figure 3:
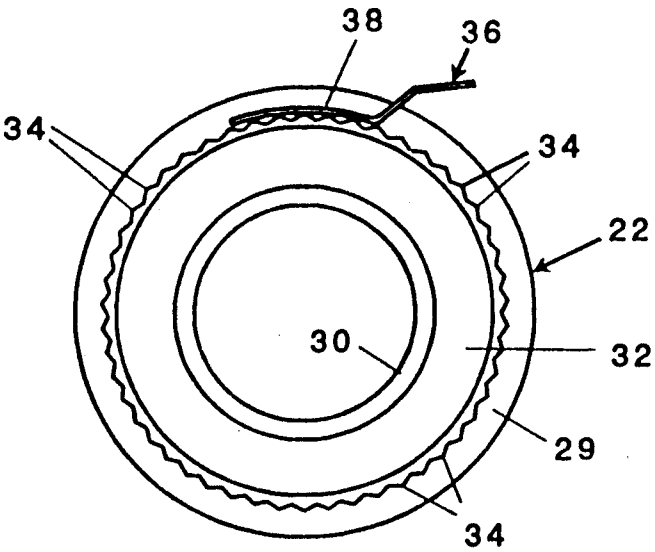
FIG. 3 is a right side view showing further details of the spool shown in FIGS. 1 and 2.

Referring now to FIGS. 2 through 4, the spool 22 is shown to comprise a circular disk 29, a cylindrical hub 30 and a feed cylinder 32 having a plurality of knurls formed on its outer periphery. The knurls 34 extend axially with respect to the spool 22 and provide crests which are of an angularity sufficient to feed the tape T over the feed cylinder 32 in a manner which will be described below.

Referring still to FIGS. 2 through 4 taken in conjunction with FIG. 1, a pressure means in the form of a leaf spring 36 is mounted on, and supported from the top wall of the housing 12. The leaf spring 36 has an arcuate surface 38 contoured to mate with the outer periphery of the feed cylinder 32, and contact the knurls 34 with the tape T disposed therebetween.

As best shown in FIG. 1, the dispenser device 10 is provided with a roll of tape T mounted on the hub 30 of the spool 22, the tape T being fed over the wedge 24 and between the knurls 34 and leaf spring 36 to a slotted or other suitable type opening 40 in the rear of the housing 12. If an opening is not provided in the housing 12, the housing may be constructed of an internal volume such that the used tape T is collected within the housing, rather than fed to the outside where the user may tear the used tape off after each usage.

The device 10 is held in the hand of the user and the tape T applied to a substrate surface by applying pressure to the wedge 24 and moving the device rearwardly along the substrate surface. Movement of the device along the substrate surface causes the tape T to unwind from the hub 30 rotating the spool 22 in the clockwise direction as shown in FIG. 1. Rotation of the spool 22 is effective to rotate the feed cylinder 32, and due to the difference in diameter between the tape outer surface on the hub 30 and the outer periphery of the feed cylinder 32, the tape T is moved at a greater linear rate over the knurls 34 than it is being unwound from the outer surface of the tape provided on the hub 30. When this occurs, slippage takes place between the knurls 34 and the arcuate surface 38 of the leaf spring 36, however maintaining tension in the tape T throughout its travel from the hub 30 to the outer periphery of the feed cylinder 32. The leaf spring 36 therefore, in conjunction with the knurls 34, creates a form of slip clutch between the hub 30 and the feed cylinder 32.

From the above, it should be evident that the outer surface of the roll of tape T mounted on the hub 30 should always be of a diameter less than the outer surface of the feed cylinder 32 which contains the knurls 34 in order to maintain a tension in the tape T throughout its travels. Further, it should be evident that the leaf spring 36 is of a sufficient spring constant to provide pressure to the tape T at the area of contact with the knurls 34 to provide friction of a magnitude to feed the tape T, but to allow slippage between the knurls and the arcuate surface 38 when the carrier tape is subjected to a predetermined tensile force.

While it is apparent that changes and modifications can be made within the spirit and scope of the present invention, it is my intention, however, only to be limited by the appended claims.

As my invention I claim:

1. A hand operated device for transferring a film from a carrier tape to a substrate comprising:

wall structure forming a housing having an applicator means and a single spool mounted for rotation within said housing;

said spool having a portion carrying a roll of carrier tape and being supported for feeding the carrier tape over said applicator means;

a portion of said spool adjacent said roll carrying portion having an outer perimeter disposed for receiving said carrier tape after its passage over said applicator means; and spring means forcing said carrier tape against said spool outer perimeter for driving said carrier tape after its passage over said applicator means and allowing slippage therebetween to prevent breakage of said carrier tape.

2. A device as set forth in claim 1 wherein said roll of carrier tape is of a diameter less than the spool diameter forming said spool outer periphery.

3. A device as set forth in claim 1 wherein said spool perimeter is provided with a plurality of radially extending knurls for contacting said carrier tape.

4. A device as set forth in claim 1 wherein said spring means comprises a leaf spring arm having one end supported on said wall structure and the free end contacting said spool outer perimeter.

5. A device as set forth in claim 1 wherein said wall structure includes means for retaining said carrier tape after being fed between said spool outer perimeter and said spring means.

6. A device as set forth in claim 1 wherein said wall structure includes means for feeding said carrier tape from within said housing.

7. A device as set forth in claim 2 wherein said spool outer perimeter is provided with a plurality of radially extending knurls for contacting said carrier tape.

8. A device as set forth in claim 7 wherein said spring means comprises a leaf spring arm having one end supported on said wall structure and the free end contacting said spool outer perimeter.

9. A device as set forth in claim 8 wherein said wall structure includes means for retaining said carrier tape after being fed between said spool outer perimeter and said leaf spring arm.

10. A device as set forth in claim 8 wherein said wall structure includes means for feeding said carrier tape from within said housing.

11. A method of transferring a film from a carrier tape to a substrate including the steps of:

providing a housing having a single spool comprising a portion containing a roll of carrier tape and a portion adjacent said roll containing portion having an outer perimeter, and an applicator means for contacting the substrate;

feeding said carrier tape from said single spool containing portion over said applicator means and over the periphery of said single spool outer perimeter; and providing pressure to said carrier tape at the area of contact with said spool outer periphery of sufficient force to cause friction between said spool outer periphery and said carrier tape to feed said carrier tape, and to allow slippage between said spool outer periphery and said carrier tape when said carrier tape is subjected to a predetermined tensile force.

12. A method as set forth in claim 11 wherein said roll of carrier tape is of a diameter less than the diameter on which is formed said single spool periphery and wherein said tensile force is caused by the difference of said diameters when said single spool outer is rotated.

13. A method as set forth in claim 11 wherein said pressure is applied to said carrier tape by a spring arm supported within said housing.

14. A method as set forth in claim 11 wherein said carrier tape is fed from said spool outer perimeter to a point outside said housing.

15. A method as set forth in claim 11 wherein said carrier tape is retained within said housing after passing over said spool outer perimeter.

* * * * *